US005186762A

United States Patent [19]

Ushigami et al.

[11] Patent Number: 5,186,762

[45] Date of Patent: * Feb. 16, 1993

[54] PROCESS FOR PRODUCING GRAIN-ORIENTED ELECTRICAL STEEL SHEET HAVING HIGH MAGNETIC FLUX DENSITY

[75] Inventors: Yoshiyuki Ushigami; Tadashi Nakayama; Nobuyuki Takahashi, all of Fukuoka, Japan

[73] Assignee: Nippon Steel Corporation, Tokyo, Japan

[ * ] Notice: The portion of the term of this patent subsequent to Mar. 3, 2008 has been disclaimed.

[21] Appl. No.: 770,775

[22] Filed: Oct. 4, 1991

Related U.S. Application Data

[63] Continuation of Ser. No. 501,165, Mar. 29, 1990, abandoned.

[30] Foreign Application Priority Data

Mar. 30, 1989 [JP] Japan ..... 1-79991
Mar. 30, 1989 [JP] Japan ..... 1-79992

[51] Int. Cl.[5] ..... C21D 8/12
[52] U.S. Cl. ..... 148/111; 148/113
[58] Field of Search ..... 148/111, 112, 113, 16.6

[56] References Cited

U.S. PATENT DOCUMENTS

| | | | |
|---|---|---|---|
| 2,867,559 | 1/1959 | May | 148/111 |
| 2,913,361 | 11/1959 | Fitz | 148/110 |
| 4,888,066 | 12/1989 | Yoshitomi et al. | 148/111 |
| 4,938,807 | 7/1990 | Takahashi et al. | 148/111 |
| 4,979,997 | 12/1990 | Kobayashi et al. | 148/16.6 |
| 4,997,493 | 3/1991 | Ushigami et al. | 148/111 |

FOREIGN PATENT DOCUMENTS

| | | | |
|---|---|---|---|
| 0098324 | 1/1984 | European Pat. Off. . | |
| 0219611 | 4/1987 | European Pat. Off. . | |
| 307905 | 3/1989 | European Pat. Off. | 148/112 |
| 30-3651 | 5/1955 | Japan . | |
| 40-15644 | 7/1965 | Japan . | |
| 51-13469 | 4/1976 | Japan . | |
| 62-45285 | 9/1987 | Japan . | |

OTHER PUBLICATIONS

Patent Abstracts of Japan, vol. 9, No. 82, (C-275) (1805), Apr. 11, 1985, of Kokai No. 59-215419.
Patent Abstracts of Japan, vol. 12, No. 84, (C-482) Mar. 17, 1988, of Kokai No. 62-222024.
J. E. May & D. Turnbull, Trans. Met. Soc. AIME 212 (1958) pp. 769-781.
T. Saito, J. of Japan Institute of Metals 27 (1963) pp. 186-195.
T. Matsuoka, Tetsu-to-Hagane 53 (1967), pp. 1007-1023 (Trans. ISIJ, 7(1967) pp. 19-28 attached as English version).
K. Kuroki et al., J. of Japan Institute of Metals, 43 (1979) pp. 175-181.
K. Kuroki et al., ibid, 44 (1980), pp. 419-424.

*Primary Examiner*—George Wyszomierski
*Attorney, Agent, or Firm*—Kenyon & Kenyon

[57] ABSTRACT

A process for producing a grain-oriented electrical steel sheet having a high magnetic flux density, comprising the steps of: heating a steel slab comprising 1.8 to 4.8 wt % Si, 0.012 to 0.050 wt % acid-soluble Al, 0.010 wt % or less N, and the balance consisting of Fe and unavoidable impurities, to a temperature for hot rolling; hot-rolling the heated slab to form a hot-rolled strip; cold-rolling the hot-rolled strip to a final product sheet thickness at a final cold rolling reduction of 80% or more by a single step of cold rolling or by two or more steps of cold rolling with an intermediate annealing step inserted therebetween; primary-recrystallization-annealing the cold-rolled strip; final-annealing the primary-recrystallization-annealed strip so that secondary-recrystallized grains substantially completely grow up in a temperature region of from 1000° to 1100° C. and then purification is effected above 1100° C.; and subjecting the primary-recrystallization-annealed steel strip to a nitriding treatment before a secondary recrystallization occurs during the final annealing.

7 Claims, 7 Drawing Sheets

R = 70%

R = 80%

R = 90%

R=70%

R=80%

R=90%

PROCESS FOR PRODUCING GRAIN-ORIENTED ELECTRICAL STEEL SHEET HAVING HIGH MAGNETIC FLUX DENSITY

This application is a continuation of application Ser. No. 07/501,165 filed Mar. 29, 1990, now abandoned.

BACKGROUND OF THE INVENTION

1. Field of the Invention

The present invention relates to a process for producing a grain-oriented electrical steel sheet used as a soft magnetic material for an iron or magnet core of electrical equipments.

2. Description of the Related Art

A grain-oriented electrical steel sheet has a crystal grain orientation referred to as "Goss-orientation", in which grains are {110}<001>-oriented in terms of the Miller index, and usually has a Si content of 4.5% or less and a sheet thickness of from 0.10 to 0.35 mm. The steel sheet should have an excellent magnetic characteristic, particularly the magnetic flux density and the watt-loss characteristics and, to meet that requirement, it is important that the crystal grains are highly uniformly aligned in the Goss-orientation. This extremely high accumulation to the Goss-orientation is achieved by utilizing a catastrophic grain growth referred to as "secondary recrystallization". To control the secondary recrystallization, it is indispensable to adjust the primary-recrystallized structure prior to the secondary recrystallization and also to adjust the fine precipitates referred to as inhibitors or the elements segregating on the grain boundaries. The inhibitor suppresses the growth of the primary-recrystallized grains which are out of the Goss-orientation, and thereby, promotes the preferential growth of grains which are in the Goss-orientation.

Typical precipitates are MnS as proposed by M. F. Littman in Japanese Examined Patent Publication (Kokoku) No. 30-3651 or by J. E. May and D. Turnbull in Trans. Met. Soc. A.I.M.E. 212, 1958, p769–781, AlN as proposed by Taguchi and Sakakura in Japanese Examined Patent Publication (Kokoku) No. 40-15644, MnSe as proposed by Imanaka et al. in Japanese Examined Patent Publication (Kokoku) No. 51-13469, and (Al, Si)N as proposed by Komatsu et al in Japanese Examined Patent Publication (Kokoku) No. 62-45285.

The elements segregating on the grain boundaries are Pb, Sb, Nb, Ag, Te, Se, S, etc., as reported by Saito et al. in Journal of the Japan Institute of Metals, 27, 1963, p186–195 but these elements are used as merely an assistive agent for the precipitate inhibitors in the industries.

Although the essential conditions under which such precipitates can function as an inhibitor have not yet been fully clarified, an explanation was proposed by Matsuoka in Tetsu-to-Hagane (Iron and Steel) 53, 1967, p1007–1023 or by Kuroki et al. in Journal of the Japan Institute of Metals, 43, 1979, p-175–181 and ibid, 44, 1980, p-419–424, as summarized below.

(i) Fine precipitates should be present in an amount sufficient to suppress the growth of the primary-recrystallized grains prior to the secondary recrystallization.

(ii) Precipitates should have a certain size and should not abruptly vary by heat during annealing for effecting the secondary recrystallization.

The processes currently used in the manufacture of a grain-oriented electrical steel sheet are generally classified in the following three types.

The first type utilizes a two-step cold rolling using MnS disclosed by M. F. Littman in Japanese Examined Patent Publication (Kokoku) No. 30-3651, the second type utilizes a large reduction of 80% or more in the final cold rolling step using AlN and MnS disclosed by Taguchi and Sakakura in Japanese Examined Patent Publication (Kokoku) No. 40-15644, and the third type utilizes a two-step cold rolling using MnS (or MnSe) and Sb disclosed by Imanaka et al. in Japanese Examined Patent Publication (Kokoku) No. 51-13469.

These processes commonly use a basic technology in which a steel slab is heated at a high temperature in the hot rolling step so that an in-situ formation of inhibitors is effected to ensure the necessary precipitate amount and also to refine the precipitates.

Namely, a steel slab is heated at a high temperature, such as 1260° C. or higher in the first type process, 1350° C. or higher in the second type process when the slab contains 3% Si as disclosed in Japanese Unexamined Patent Publication (Kokai) No. 48-51852 although the temperature varies with the silicon content, or 1230° C. or higher in the third type process as disclosed in Japanese Unexamined Patent Publication (Kokai) No. 51-20716 including an example in which an extremely high temperature of 1320° C. is adopted to obtain a particularly high flux density. Under such a high temperature of slab heating, coarse precipitates present in steel matrix are once dissolved in steel to form a solid solution and then a fine precipitation occurs during hot rolling and/or the subsequent heat treatment.

Control of these precipitates, however, is very difficult and various solutions to this problem have been proposed.

Japanese Examined Patent Publication (Kokoku) No. 54-14568 proposed that chromium nitride, titanium nitride, vanadium nitride or the like is added to an annealing separator to ensure the nitrogen partial pressure in the atmosphere during final annealing in which the secondary recrystallization is effected and Japanese Examined Patent Publication (Kokoku) No. 53-50008 proposed that a sulfide such as $Fe_2S$ is added to ensure the sulfer partial pressure and suppress decomposition of the precipitates so that the secondary recrystallization is stabilized.

Nevertheless, these solutions could not enable the production of a product having an optimum magnetic characteristic.

This is essentially because it is actually impossible in the industrial practice that precipitates of a fixed size are dispersed in a fixed amount over the length and the width of a steel sheet coil by the slab heating and that this precipitation condition is kept unvaried until the secondary recrystallization begins.

The precipitation occurs under a non-equilibrium condition and is strongly affected by the prior heat and strain history. In fact, different portions of a steel slab have different heat and strain histories and a steel slab per se has a nonuniform crystal structure due to a macro-segregation of component elements over the slab thickness and to a local dispersion of the $\alpha$- and the $\gamma$-phases.

Therefore, the process for producing a grain-oriented electrical steel sheet based on the control of inhibitor is not essentially stable when used in industry.

SUMMARY OF THE INVENTION

The object of the present invention is to provide a process for industrially stably producing a grain-oriented electrical steel sheet having an excellent magnetic characteristic.

To achieve the object according to the present invention, there is provided a process for producing a grain-oriented electrical steel sheet having a high magnetic flux density, comprising the steps of:

heating a steel slab comprising 1.8 to 4.8 wt % Si, 0.012 to 0.050 wt % acid-soluble Al, 0.010 wt % or less N, and the balance consisting of Fe and unavoidable impurities to a temperature for hot rolling;

hot-rolling the heated slab to form a hot-rolled strip;

cold-rolling the hot-rolled strip to a final product sheet thickness under a final cold rolling reduction of 80% or more by a single step of cold rolling or by two or more steps of cold rolling with an intermediate annealing step inserted therebetween;

primary-recrystallization-annealing the cold-rolled strip;

final-annealing the primary-recrystallization-annealed strip so that secondary-recrystallized grains substantially completely grow up in a temperature region of from 1000° to 1100° C. and then purification is effected above 1100° C.; and subjecting the primary-recrystallization-annealed steel strip to a nitriding treatment before a secondary recrystallization occurs during the final annealing.

The present invention provides a process for stably producing a steel sheet product having a high flux density by defining the primary-recrystallized texture and the secondary recrystallization temperature.

DESCRIPTION OF THE PREFERRED EMBODIMENTS

The present inventors carried out a detailed study on the growth behavior of secondary-recrystallized grains and found the following novel point.

When the secondary-recrystallized grains substantially completely grow up in the temperature region of from 1000° to 1100° C. in a material having a primary-recrystallized texture having a {111}<112> orientation as a main orientation, which is established under a final cold rolling reduction of 80% or more, grains having the Goss-orientation can grow preferentially, and under this condition, a mere nitriding treatment is sufficiently effective to ensure a certain amount of inhibitors for obtaining a good magnetic characteristic.

This finding was obtained through the following experiment.

A steel slab comprising 3.3 wt % Si, 0.027 wt % acid-soluble Al, 0.007 wt % N, 0.054 wt % C, 0.13 wt % Mn, 0.007 wt % S, and the balance consisting of Fe and unavoidable impurities was hot-rolled to form a 2.3 mm thick hot-rolled strip, which was then annealed at 1100° C. for 2 min and cold-rolled at a reduction of 88% to a final product thickness of 0.2 mm. The cold-rolled strip was subjected to a primary recrystallization annealing, during which a decarburization treatment was also effected, followed by a nitriding treatment in an ammonia atmosphere to increase the nitrogen content of the steel strip by 0.005% or 0.018%. MgO was applied on the samples from the steel strip, which samples were then heated to 900° C. at a heating rate of 30° C./hr in an atmosphere of 10% $N_2$ plus 90% $H_2$ and rapidly heated to temperatures of from 950° to 1200° C. and held there for 20 hours to effect an annealing so that secondary-recrystallized grains fully grew up. During this sequence, some samples were taken out of the heating furnace when they were heated to 900° C. and an observation showed that the primary-recrystallized structure remained unchanged.

Figure 1:
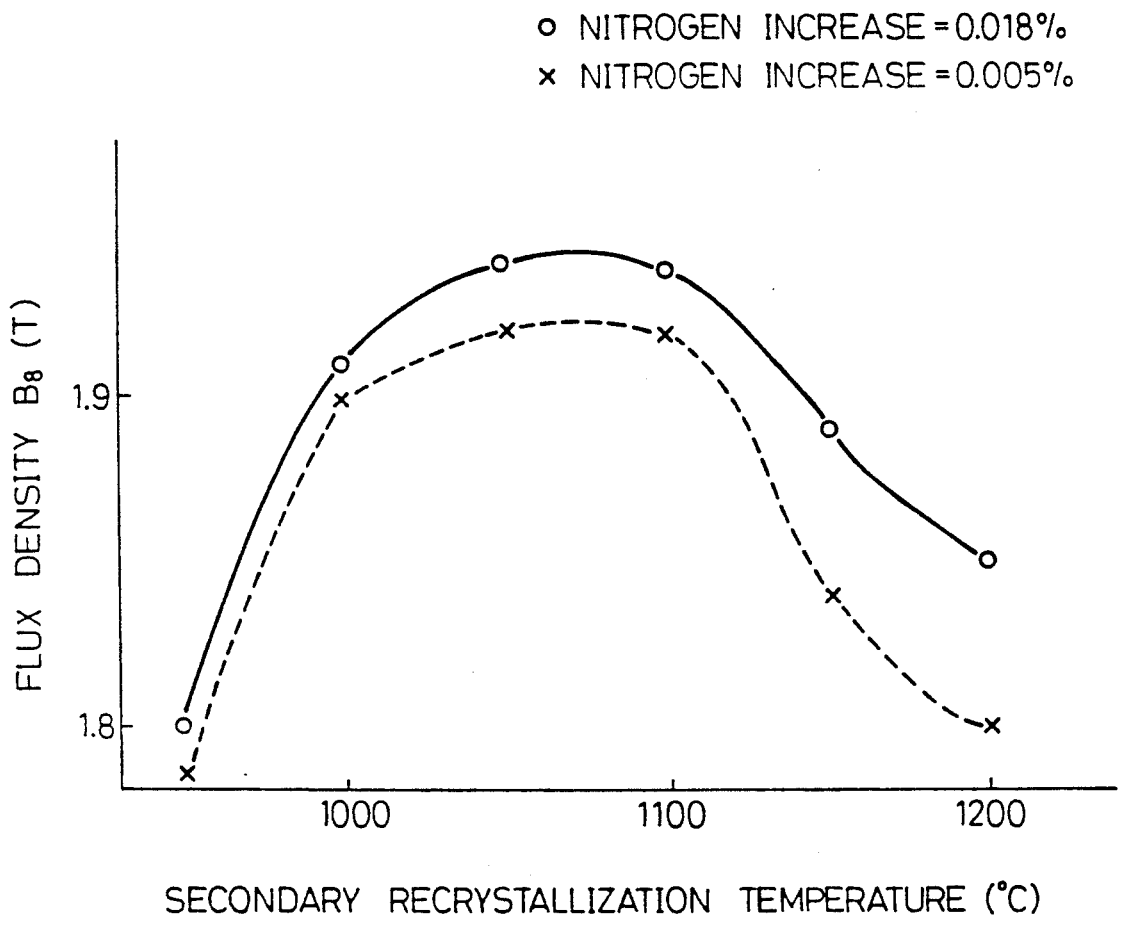
FIG. 1 shows the relationship between the magnetic flux density ($B_8$) and the secondary recrystallization temperature.

FIG. 1 shows the relationship between the magnetic flux density ($B_8$ value) and the secondary recrystallization temperature for the thus obtained sample products.

From FIG. 1, it is evident that a high flux density of 1.90 Tesla or higher is obtained for the secondary recrystallization temperatures of from 1000° to 1100° C. and that samples of higher nitriding amount (or nitrogen content increase) exhibit a higher flux density.

Based on these results, the following experiment was carried out for studying the nitriding amount and the secondary recrystallization temperature.

Other samples from the above-mentioned primary-recrystallized strip were subjected to a nitriding treatment to cause various amounts of the nitrogen content to increase, followed by an application of MgO. The MgO-applied samples were final-annealed in an atmosphere of 10% $N_2$ plus 90% $H_2$ through the following heat cycle (A) or (B):

(A) Heating to 1050° C. at a heating rate of 25° C./hour, holding there for 20 hours, and heating to 1200° C. at a heating rate of 25° C./hour.

(B) Heating to 1200° C. at a heating rate of 25° C./hour.

Figure 2:
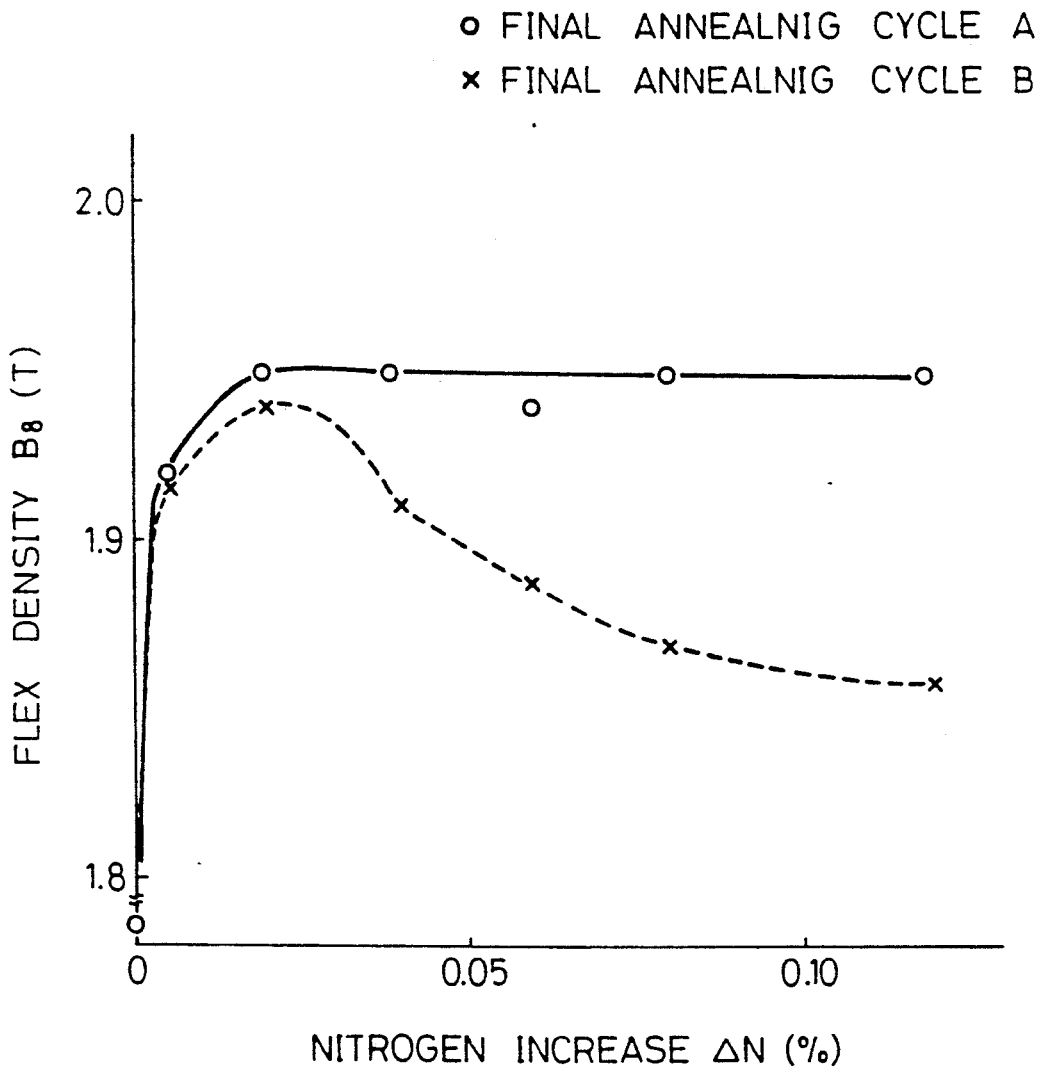
FIG. 2 shows the relationship between the magnetic flux density ($B_8$) and the nitrogen content increment achieved by nitriding treatment.

Thereafter, the atmosphere was changed to a 100% $H_2$ atmosphere and the samples were held in this condition for 20 hours to effect a purification annealing. FIG. 2 shows the flux density ($B_8$ value) for the thus obtained sample products.

From FIG. 2, it is evident that a product having a higher flux density is obtained through the heat cycle (A), in which the secondary recrystallization temperature is optimized, than through the conventional heat cycle (B). It should be noted as a more important fact that, although a high flux density exceeding 1.90 Tesla can be obtained only for a narrow range between 0.005% and 0.040% of the nitrogen content increase in the conventional heat cycle (B), the high flux density can be obtained for a wider range of 0.005% or higher of the nitrogen content increase in the heat cycle (A), in which the secondary recrystallization temperature is controlled according to the present invention.

This is due to the fact that, in the conventional process, the secondary-recrystallized grains grow at lower temperatures when the nitriding amount is low and, when the nitriding amount is high, the secondary-recrystallized grains grow at higher temperatures outside the optimum temperature region where the grains having the Goss-orientation grow preferentially.

A study showed that nitriding suppresses the reduction rate of the inhibitor amount. An experiment was then carried out for the nitrogen partial pressure in the temperature range of from 1000° to 1100° C. as a main parameter to affect a denitriding rate.

Figure 3:
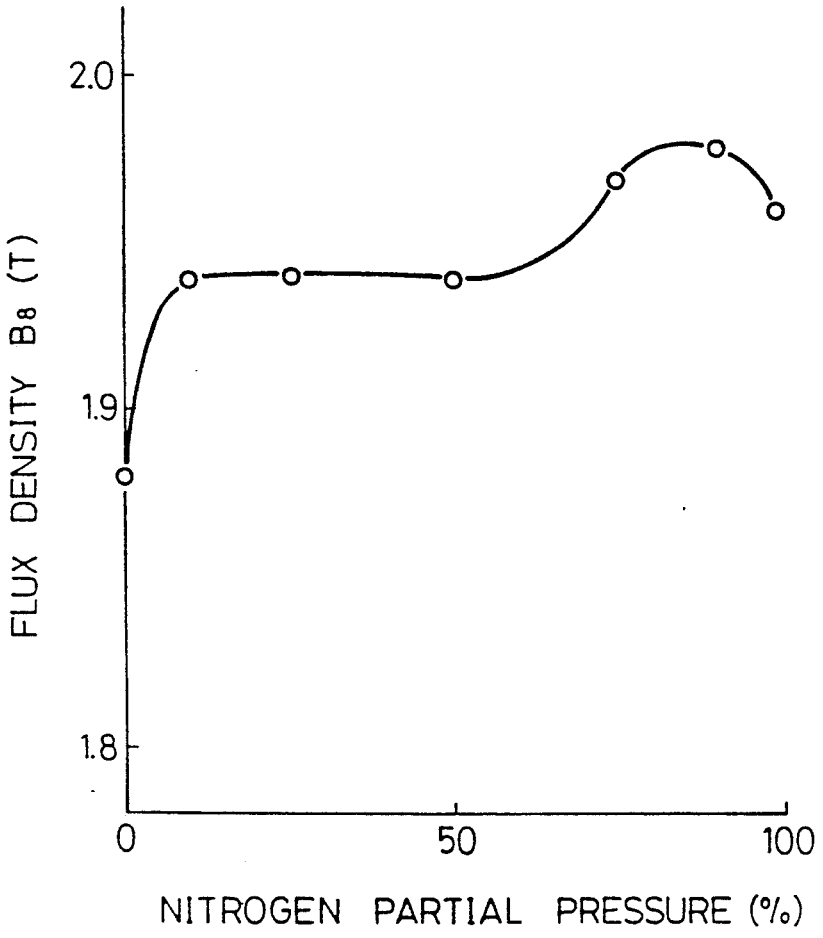
FIG. 3 shows the relationship between the magnetic flux density ($B_8$) and the nitrogen partial pressure of atmosphere.

FIG. 3 shows the relationship between the flux density ($B_8$)of the product sheets and the partial nitrogen pressure of the atmosphere when the secondary-recrystallized grains grow at 1050° C. in a material preliminarily subjected to a nitriding treatment to increase the nitrogen content by 0.018%.

From FIG. 3, it is evident that a product sheet having a high flux density of 1.90 Tesla or higher is obtained for a partial nitrogen pressure of 10% or higher and, in particular, a flux density higher than 1.95 Tesla is obtained when the partial nitrogen pressure is 75% or higher.

Figure 4:
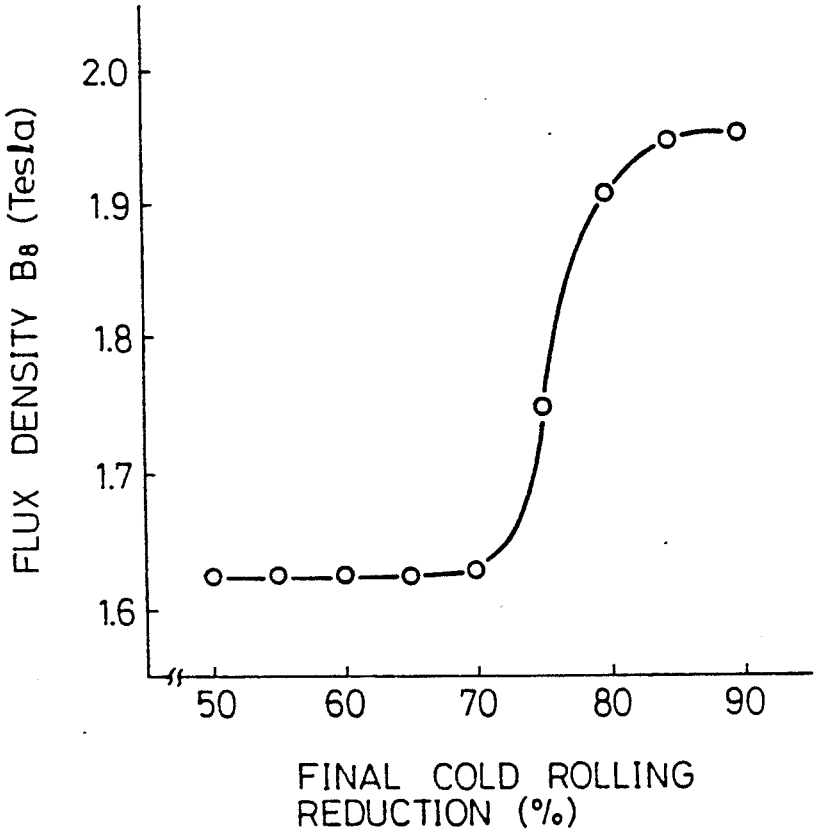
FIG. 4 shows the relationship between the magnetic flux density ($B_8$) and the final cold rolling reduction.
Figure 5A:
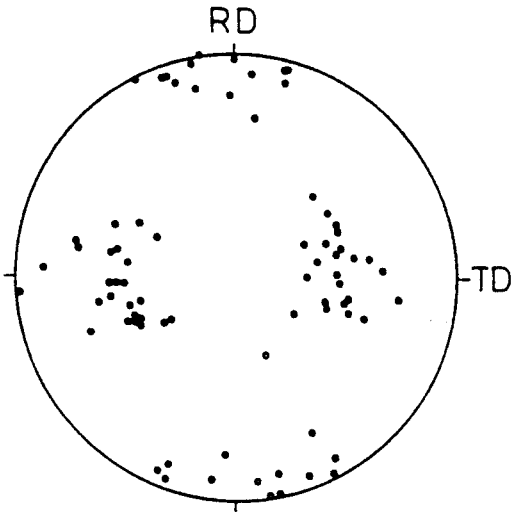
FIG. 5 the orientation distribution of the secondary-recrystallized grains in the final product sheets obtained through the final cold rolling reductions of (a) 70%, (b) 80% and (c) 90%.
Figure 5B:
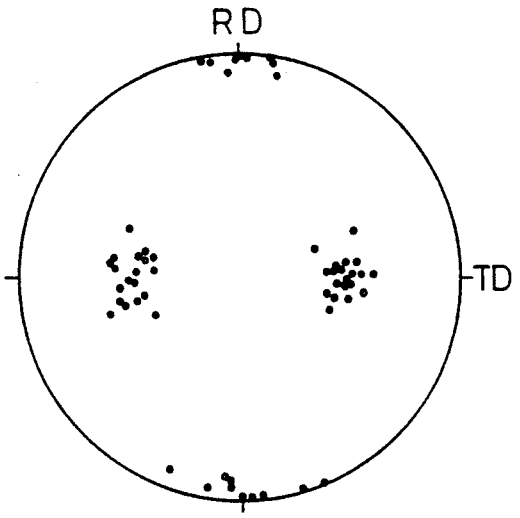
Figure 5C:
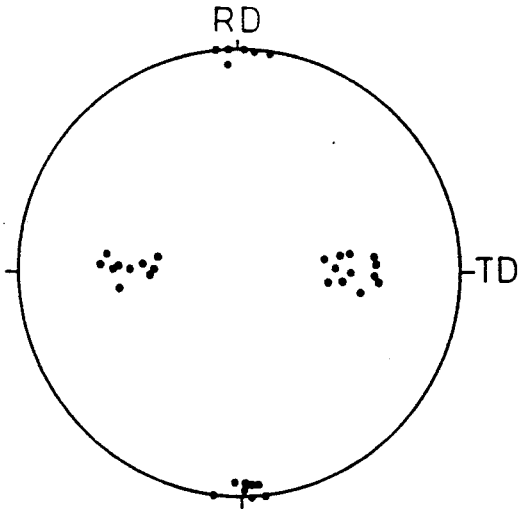
Figure 6A:
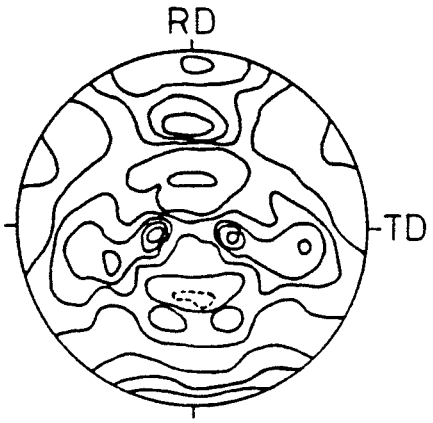
FIG. 6 shows the pole figures for the primary-recrystallized textures obtained when the final cold rolling reductions are (a) 70%, (b) 80% and (c) 90%.
Figure 6B:
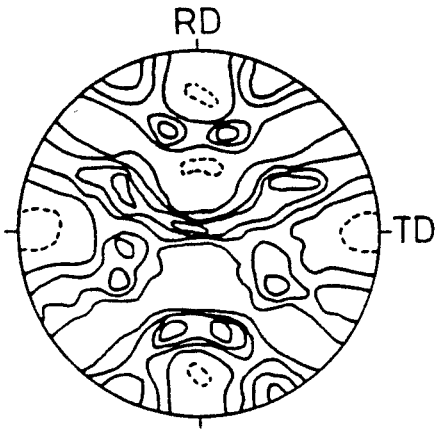
Figure 6C:
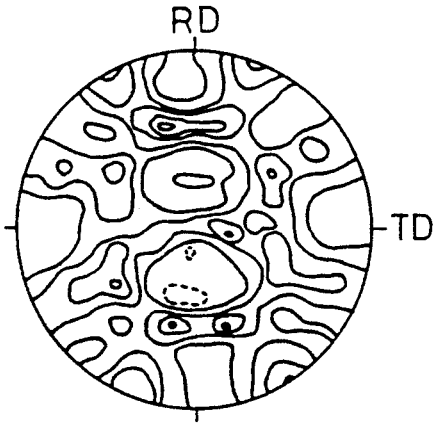

The optimum temperature range of from 1000° to 1100° C. is considered to enable the preferential growth of grains having a sharp Goss-orientation when the primary-recrystallized texture has as a main orientation a {111}<112>-orientation established through a cold rolling reduction of 80% or higher. To study the influence of the final cold rolling reduction, an experiment was carried out, in which sheet samples cold-rolled at various final reductions of from 50 to 90% were final-annealed at 1050° C. during which the secondary-recrystallized grains grew. The result showed that a sharp Goss-orientation was established for the final cold rolling reduction (R) of 80% or higher as shown in FIGS. 4 and 5 and a product sheet having a high flux density was obtained. A study showed that, for the product sheets for a final reduction (R) of 80% or higher and exhibiting a high flux density, the corresponding primary-recrystallized materials had a texture having a main orientation of {111}<112>-orientation as shown in FIG. 6.

It is a novel finding which has never been known that grains having the Goss-orientation grow preferentially in a certain temperature range in response to the primary-recrystallized texture.

The essential principle on which the present invention is based is summarized as follows.

The basic fact is that grains having the Goss-orientation grow preferentially in the specified temperature range of from 1000° to 1100° C. in response to the primary-recrystallized texture established through the final cold rolling reduction of 80% or higher. Under the provision that the secondary-recrystallized grains are allowed to grow in the specified temperature range, merely nitriding or increasing the partial nitrogen pressure of the atmosphere is sufficient to ensure a certain amount of inhibitors and to suppress the reduction rate of the inhibitor amount during the secondary recrystallization, so that the conventional problems due to nonuniform distribution of inhibitors is solved to enable the stable production of a grain-oriented electrical steel sheet having a high flux density.

This principle of the present invention is quite different from that of the conventional process.

Although Japanese Unexamined Patent Publication (Kokai) No. 48-72025 disclosed a process in which the secondary recrystallization temperature is limited in the range of from 1000° to 1100° C., the primary-recrystallized texture was not taken into consideration, and moreover, MnS used as an inhibitor is unstable in that temperature range as shown by W. M. Swift in Metallurgical Transaction, 4, 1973, p153–157 with the result that a low flux density of merely 1.8 Tesla was obtained.

The specified limitations of the present invention will be described below.

A steel slab used in the present invention contains 1.8 to 4.8 wt % Si, 0.012 to 0.050 wt % acid-soluble Al, 0.010 wt % or less N, and the balance consisting of Fe and unavoidable impurities, but may contain elements other than those specified above.

A material containing Si in an amount more than 4.8 wt % cannot be cold-rolled because cracking easily occurs during cold rolling. On the other hand, when the Si content is reduced, an α-to-γ transformation occurs during final annealing and the orientation of crystal grains is broken. The Si content of 1.8 wt % or more does not substantially affect the crystal orientation due to the α-to-γ transformation.

The acid-soluble Al is bonded with N to form AlN or (Al, Si) N, which functions as an inhibitor. When Al is utilized for this purpose by a later nitriding treatment, it is particularly effective that Al is present as a free Al. The acid-soluble Al content is limited in the range of from 0.012 to 0.050 wt %, in which a high flux density is obtained.

The N content must not exceed 0.010 wt % because a void referred to as a "blister" is formed in a steel sheet for a higher amount of N.

Additive elements such as Mn, S, Se, B, Bi, Nb, Cr, Sn, and Ti may be used as inhibitor forming elements.

The slab heating temperature is not necessarily limited and need not be as high as that used in the conventional process because inhibitors can be formed in-situ in a later step of nitriding treatment. The slab heating temperature should not preferably exceed 1300° C. from the viewpoint of production cost.

In a preferred embodiment of the present invention, the slab heating temperature is more specifically controlled in accordance with the Al and the N contents not to exceed a temperature above which AlN is completely dissolved in steel. Generally, the slab heating temperature is not preferably lower than 1000° C. because the deformation resistance of the slab increases with lowering of the heating temperature and the steel sheet shape becomes difficult to ensure. On the other hand, when a slab is heated to a temperature higher than 1270° C., oxidation of the slab surface excessively occurs to form a melt referred to as "scum". The slab heating temperature is preferably in the range of from 1000° to 1270° C.

In relation to the above point of view, the present inventors carried out a more detailed study on inhibitors.

The primary-recrystallized grain size is determined by the condition of primary recrystallization annealing including the annealing temperature and duration time and is affected more essentially by the inhibitors which are present before the primary recrystallization annealing.

If an inhibitor necessary for the secondary recrystallization is formed in-situ prior to the primary recrystallization annealing by a high temperature heating of the slab as in the conventional process, the primary recrystallization annealing must be carried out at a higher temperature and/or for a longer time duration to undesirably raise the production cost, in order to obtain a grain size comparable with that obtained by the present invention, for example, the average grain diameter (D) of about 15 μm or greater. Moreover, a higher temperature and/or a longer time may cause an abnormal grain growth during the primary recrystallization temperature, with the result that the secondary recrystallization becomes unstable.

Therefore, with regard to inhibitors, it is more reasonable that, contrary to the conventional process, a steel slab is heated to a relatively lower temperature at which AlN is not completely dissolved to form a weak inhibitor to be present prior to the primary recrystallization annealing and, after adjusting the primary-recrystallized structure, the inhibitor necessary for the secondary recrystallization is formed in-situ by a nitriding treatment.

The dissolving temperature of AlN is determined by the product of the Al and the N contents of a steel slab and is typically expressed by the following equation by Iwayama et al. in Journal of Magnetism and Magnetic Materials, 19, 1980, p15–17:

$$\log[Al\%][N\%] = -10062T + 2.72$$

The slab heating temperature can be determined from the Al and the N contents by using the above equation.

The above-described idea that inhibitors are separately utilized in the stages before and after the primary recrystallization annealing is quite novel and has never been present in the conventional process. The present inventors developed this idea through finding the important effect of the primary-recrystallized grain structure.

The heated steel slab is subsequently hot-rolled to form a hot-rolled strip.

The hot-rolled strip is annealed, if necessary, at a temperature of from 750° to 1200° C. for 30 sec to 30 min.

The hot-rolled strip is cold-rolled to a final product sheet thickness under a final cold rolling reduction of 80% or more by a single step of cold rolling or by two or more steps of cold rolling with an intermediate annealing therebetween. The reduction of 80% or more is essential for obtaining a desired primary-recrystallized texture.

A cold-rolled strip is subjected to a primary-recrystallization annealing, in which a decarburization is effected to remove carbon usually contained in steel. The annealing condition including temperature and duration time should be determined so that the primary-recrystallized grains have an average grain diameter of about 15 μm or greater.

The strip thus obtained is coated with an annealing separator and is then subjected to a final annealing for effecting a secondary recrystallization and a purification.

It is essential in the present invention that the strip which has been primary-recrystallization-annealed is subjected to a nitriding treatment before the secondary recrystallization in the final annealing step occurs and that the secondary-recrystallized grains are allowed to substantially completely grow in the temperature region of from 1000° to 1100° C. The nitriding treatment may be carried out in any conventional way for nitriding, for example, nitriding using a gas atmosphere having a nitriding ability such as ammonia gas, nitriding during the final annealing by using an annealing separator containing a metal nitride additive having a nitriding ability such as manganese nitride, chromium nitride, or the like.

As previously described, the nitriding carried out after the primary recrystallization annealing and before the beginning of the secondary recrystallization, strengthens the previously formed weak inhibitor to stabilize the secondary recrystallization.

In a preferred embodiment of the present invention, the final annealing of the primary-recrystallization-annealed strip is carried out so that secondary-recrystallized grains substantially grow in a temperature region T defined in the following expressions (1) and (2), as specified in claim 2:

$$T \leqq 20D + 700 \quad (1)$$

$$1000 \leqq T \leqq 1100 \quad (2)$$

where "D" denotes the average grain diameter of primary-recrystallized grains, in μm.

This is based on the novel finding that grains having the Goss-orientation can grow preferentially by defining the texture and the grain structure of primary-recrystallized grains and the secondary recrystallization temperature and controlling the thermal growth behavior of crystal grains.

This finding was obtained through the following experiment.

Steel slabs comprising 3.2 to 3.3 wt % Si, 0.010 to 0.045 wt % acid-soluble Al, 0.0030 to 0.0090 wt % N, 0.020 to 0.090 wt % C, 0.070 to 0.500 wt % Mn, 0.0030 to 0.0300 wt % S, and the balance Fe and unavoidable impurities were heated to different temperatures of from 1150° to 1400° C. and hot-rolled to form 2.3 mm thick hot-rolled strips, which were then annealed at different temperatures of from 900° to 1200° C. and cold-rolled at a reduction of 88% to a final thickness of 0.285 mm. The cold-rolled strips were primary-recrystallization-annealed at temperatures of from 830° to 1000° C., during which a decarburization was also effected. An annealing separator containing MgO as a main component was then applied on the strips.

Samples from the strips were heated to 900° C. at a heating rate of 20° C./hour in an atmosphere of 10% $N_2$ plus 90% $H_2$ and then rapidly heated to predetermined different temperatures of from 950° to 1200° C. and held there for 20 hours so that the secondary-recrystallized grains were allowed to fully grow. During this sequence, some samples were taken out of the heating furnace when they were heated to 900° C. and an observation showed that the primary-recrystallized grain sizes remained unchanged.

Figure 7:
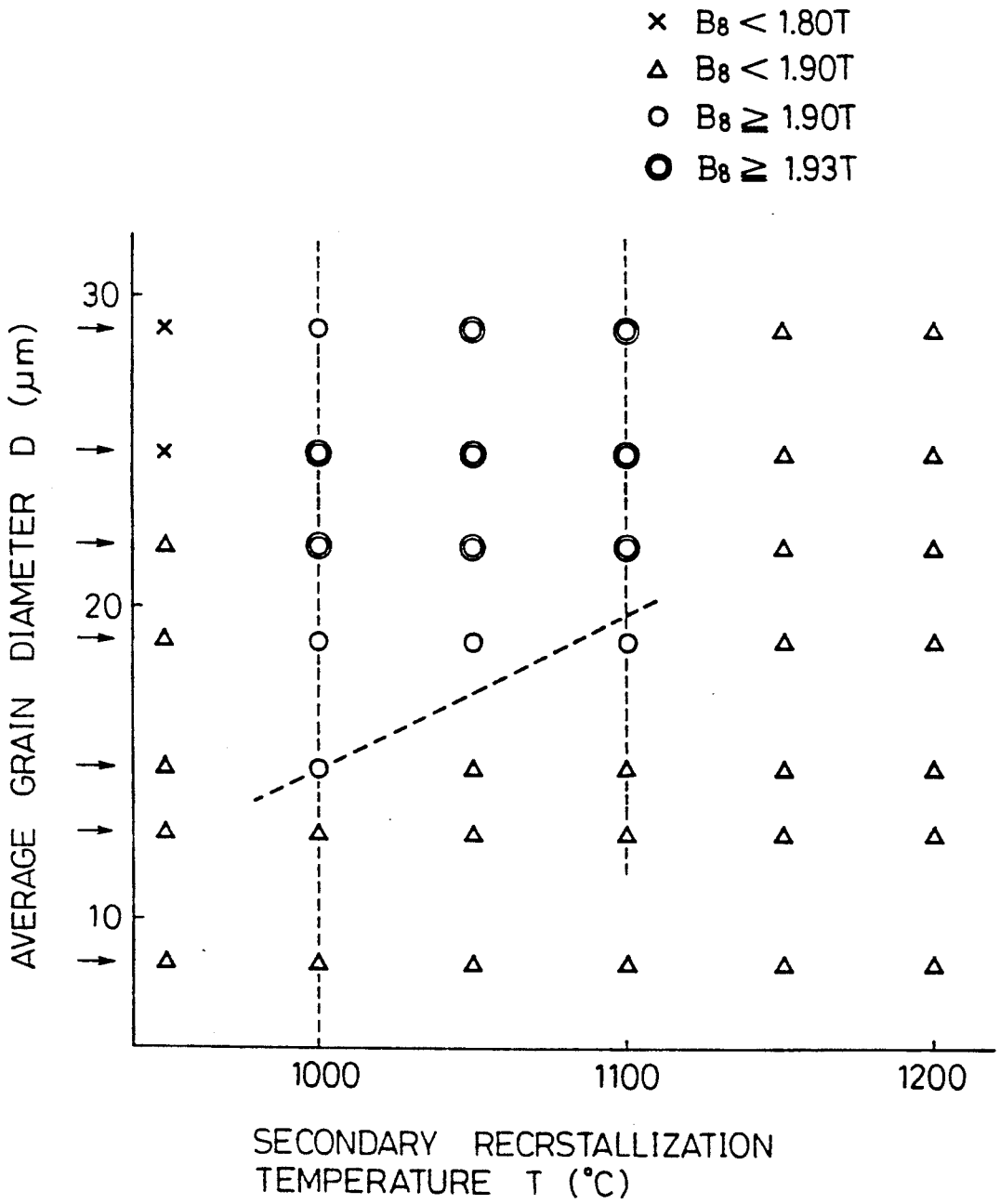
FIG. 7 shows the relationship among the magnetic flux density ($B_8$), the average diameter of primary-recrystallized grains, and the secondary recrystallization temperature.

FIG. 7 shows the relationship among the magnetic flux density ($B_8$), the average grain diameter of primary-recrystallized grains, and the secondary recrystallization temperature for the above-obtained sample products.

It is seen from FIG. 7 that the product sheets have a high flux density exceeding 1.92 T when the average grain diameter D (μm) of primary-recrystallized grains and the secondary recrystallization temperature T (°C.) satisfy the following relationship:

$$T \leqq 20D + 700 \quad (1)$$

$$1000 \leqq T \leqq 1100 \quad (2)$$

The present inventors consider that the reason for this result is as follows.

The secondary recrystallization is a phenomenon in which the thermal change of primary-recrystallized structure and the thermal change of inhibitor are competing. Namely, as the inhibitor becomes weak during final annealing, the grains having orientations close to the Goss-orientation, which are present in a scattered condition, form a nucleus and begin to grow. The growth rate V (cm/sec) of secondary-recrystallized grains is generally expressed by the following equation:

$$V \propto \exp(-Q/RT) \cdot 1/d$$

where Q is the activation energy for the grain growth and R is a gas constant.

Therefore, when the primary-recrystallized grain diameter (D) is large and the secondary recrystallization temperature (T) is low, the growth rate of secondary-recrystallized grains is generally slow and grains having a sharp Goss-orientation can grow relatively faster overcoming the suppression by inhibitors, whereas, when the primary-recrystallized grain diameter (D) is small and the secondary recrystallization temperature (T) is high, grains having orientations near the Goss-orientation also can grow to degrade the accumulation degree of grain orientation. Accordingly, in a preferred embodiment of the present invention, as specified in claim 2, the secondary recrystallization temperature is defined in accordance with the primary-recrystallized grain diameter (D). In this preferred embodiment in which the secondary recrystallization temperature (T) is further limited by the primary-recrystallized grain size (D), a sharp Goss-orientation as shown in FIGS. 3 and 4 can be more easily ensured than in the case in which the temperature is only limited to the range between 1000° and 1100° C.

The method of controlling the secondary recrystallization temperature, i.e., the temperature at which the secondary-recrystallized grains are allowed to grow is not limited and may carried out by holding or slow heating in the corresponding temperature region.

EXAMPLES

Example 1

A steel slab consisting of 3.3 wt % Si, 0.030 wt % acid-soluble Al, 0.008 wt % N, 0.05 wt % C, 0.14 wt % Mn, 0.007 wt % S and the balance Fe and unavoidable impurities was hot-rolled to form a 1.8 mm thick hot-rolled strip. The hot-rolled strip was annealed at 1100° C. for 2 min and then cold-rolled at a reduction of 88% to a final product thickness of 0.20 mm. The cold-rolled strip was subjected to a primary recrystallization annealing at 830° C., during which a decarburization was also effected. Thereafter, MgO mixed with 0, 3, 5, and 15% of ferro-manganese nitride was applied on the strip for the following nitriding treatment. The strip was final annealed by heating to 1070° C. in an atmosphere of 25% $N_2$ plus 75% $H_2$ and held at the temperature for 20 hours in a changed atmosphere of 75% $N_2$ plus 25% $H_2$, so that the secondary-recrystallized grains were allowed to almost completely grow. The strip was then subjected to a purification treatment by annealing at 1200° C. for 20 hours in an atmosphere of 100% $H_2$. The magnetic characteristic of the thus obtained product sheets is shown in Table 1.

TABLE 1

| Ferro-manganese nitride percentage | Flux density ($B_8$) | Note |
|---|---|---|
| 0 | 1.88 T | Comparative sample |
| 3 | 1.94 T | Present invention |
| 5 | 1.96 T | " |
| 15 | 1.97 T | " |

Example 2

Steel slabs comprising 3.28 wt % Si, 0.027 wt % acid-soluble Al, 0.0060 wt % N, 0.14 wt % Mn, 0.007 wt % S and the balance Fe and unavoidable impurities were heated to different temperatures of 1150° and 1300° C. and hot-rolled to form 1.8 mm thick hot-rolled strips. The strips were annealed by heating at 1150° C. for 30 sec and subsequently holding at 900° C. for 30 sec. The strips were then cold-rolled at a reduction of 89% to a final sheet thickness of 0.20 mm. The cold-rolled strips were primary-recrystallization-annealed at 850° C. for 90 sec, during which a decarburization was also effected. An annealing separator containing MgO as a main component and mixed with ferro-manganese nitride was applied on the annealed strips, which were then final-annealed in an atmosphere of 25% $N_2$ plus 75% $H_2$ through the following heat cycles (A) and (B):

(A) Heating to 1200° C. at a heating rate of 30° C./hr.

(B) Heating to 1070° C. at a heating rate of 30° C./hr, holding there 10 hours and then heating to 1200° C. at a heating rate of 30° C./hr.

Thereafter, the strips were heated at 1200° C. for 20 hours in an atmosphere of 100% $H_2$ to effect a purification. The characteristics of the thus obtained product sheet are shown in Table 2.

TABLE 2

| Slab heating temperature | Primary-recrystallized grain diameter | Heat cycle of final annealing | Flux density ($B_8$) |
|---|---|---|---|
| 1150° C. | 22 μm | A | 1.88 T |
| | | B | 1.95 T |
| 1300° C. | 13 μm | A | 1.78 T |
| | | B | 1.84 T |

Example 3

Samples from the primary-recrystallization-annealed strip obtained when the steel slab was heated at 1300° C. were additionally heat-treated at 950° C. A primary-recrystallized grain has a grain diameter of 20 μm. A final annealing was carried out under the same condition as that in Example 2. The characteristics of the thus obtained products are shown in Table 3.

TABLE 3

| Heat cycle of final annealing | Flux density ($B_8$) |
|---|---|
| A | 1.87 T |
| B | 1.92 T |

Example 4

A steel slab comprising 3.3 wt % Si, 0.030 wt % acid-soluble Al, 0.003 wt % N, 0.048 wt % C, 0.13 wt % Mn, 0.010 wt % S, and the balance Fe and unavoidable impurities was heated to 1100° C. and hot-rolled to a 2.0 mm thick hot-rolled strip. The strip was annealed at 1000° C. and cold-rolled at a reduction of 89% to a final thickness of 0.23 mm. Samples from the cold-rolled strip were primary-recrystallization-annealed at different temperatures of 800°, 850°, and 900° C. for 120 sec, during which a decarburization was also effected. The samples were then subjected to a nitriding treatment in an atmosphere of ammonia gas so that the nitrogen content was increased by 0.02 to 0.03 wt %. An annealing separator was applied on the nitrided samples, which were then final-annealed by heating to 1000° C. at a heating rate of 25° C./hr in an atmosphere of 10% $N_2$ plus 90% $H_2$, then heating to 1100° C. at a heating rate of 5° C./hr, subsequently heating to 1200° C. at a heating rate of 25° C./hr and holding there in a changed atmosphere of 100% $H_2$ to effect purification. During this sequence, some samples were taken out of the heating furnace when heated to temperatures of 1000° and 1100° C. and an observation showed that the secondary recrystallization was substantially performed between these temperatures. The thus obtained products had the characteristics as shown in Table 4.

TABLE 4

| Primary recrystallization temperature | Primary-recrystallized grain diameter | Flux density ($B_8$) |
|---|---|---|
| 800° C. | 14 μm | 1.89 T |
| 850° C. | 24 μm | 1.94 T |
| 900° C. | 27 μm | 1.95 T |

We claim:

1. A process for producing a grain-oriented electrical steel sheet having a high magnetic flux density, comprising the steps of:

heating a steel slab comprising 1.8 to 4.8 wt % Si, 0.012to 0.050 wt % acid-soluble Al, 0.010 wt % or less N, and the balance being Fe and unavoidable impurities to a temperature for hot rolling;

hot-rolling the heated slab to form a hot-rolled strip;

cold-rolling the hot-rolled strip to a final product sheet thickness at a final cold rolling reduction of 80% or more by a single step of cold rolling or by two or more steps of cold rolling with an intermediate annealing step inserted therebetween;

primary-recrystallization-annealing the cold rolled strip;

nitriding the primary-recrystallization-annealed strip during a period from after the primary-recrystallization annealing and before the beginning of secondary recrystallization during secondary recrystallization annealing to increase the amount of nitrogen in the steel strip by above 0.005%;

subjecting the nitrided primary-recrystallization annealed strip to secondary recrystallization annealing, which comprises developing and completing secondary recrystallization at a temperature of from 1000° to 1100° C.

2. A process according to claim 1, wherein said secondary recrystallization annealing of the primary-recrystallization-annealed strip is carried out so that secondary-recrystallized grains substantially completely grow up in a temperature region T (°C.) defined by the following expressions (1) and (2):

$$T \leqq 20D + 700 \quad (1)$$

$$1000 \leqq T \leqq 1100 \quad (2)$$

where "D" denotes the average diameter of primary-recrystallized grains, in mm.

3. A process according to claim 1 or 2, wherein the atmosphere during the secondary recrystallization annealing is controlled so that the nitrogen partial pressure of the atmosphere is 10% or higher when the secondary-recrystallized grains grow in said temperature region of from 1000° to 1100° C.

4. A process according to claim 3, wherein said nitrogen partial pressure is 75% or higher.

5. A process according to claim 1 or 2, wherein said nitriding treatment is carried out to increase the nitrogen content of aid steel slab by 0.02% or more.

6. A process according to claim 1 or 2, wherein said heating of said steel slab is carried out at a temperature at which Al and N are not completely dissolved in steel.

7. A process according to claim 1 wherein at the secondary recrystallization annealing, the steel sheet is held at a temperature range of from 1000° C. to 1100° C. for at least 10 hours.

* * * * *

UNITED STATES PATENT AND TRADEMARK OFFICE

CERTIFICATE OF CORRECTION

PATENT NO. : 5,186,762

DATED : February 16, 1993

INVENTOR(S) : Yoshiyuki USHIGAMI, et al.

It is certified that error appears in the above-identified patent and that said Letters Patent is hereby corrected as shown below:

Column 9, line 16, change "1/d" to --1/D--.

Column 12, line 36, change "aid" to --said--.

Signed and Sealed this

Fourteenth Day of December, 1993

*Attest:*

*Attesting Officer*

BRUCE LEHMAN

*Commissioner of Patents and Trademarks*